US007055194B2

(12) United States Patent
Arthur

(10) Patent No.: US 7,055,194 B2
(45) Date of Patent: Jun. 6, 2006

(54) COT

(75) Inventor: Jenny Maree Arthur, Wellington (NZ)

(73) Assignee: Kraka Design Limited, Wellington (NZ)

( * ) Notice: Subject to any disclaimer, the term of this patent is extended or adjusted under 35 U.S.C. 154(b) by 0 days.

(21) Appl. No.: 10/399,431

(22) PCT Filed: Oct. 17, 2001

(86) PCT No.: PCT/NZ01/00229

§ 371 (c)(1),
(2), (4) Date: Sep. 5, 2003

(87) PCT Pub. No.: WO02/32273

PCT Pub. Date: Apr. 25, 2002

(65) Prior Publication Data

US 2004/0025251 A1 Feb. 12, 2004

(30) Foreign Application Priority Data

Oct. 17, 2000 (NZ) ..... 507590

(51) Int. Cl.
*A47D 7/02* (2006.01)

(52) U.S. Cl. ..... 5/428; 5/100

(58) Field of Classification Search ..... 5/93.1, 5/98.1, 100, 425, 427, 428, 9.1, 93.2, 97, 5/110, 111, 113, 121, 424, 429, 512; D6/391
See application file for complete search history.

(56) References Cited

U.S. PATENT DOCUMENTS 275,070 A * 4/1883 Opdyke ..... 5/100
321,649 A * 7/1885 Shelley ..... 5/427
959,168 A * 5/1910 Richardson ..... 5/97
1,450,497 A * 4/1923 Griffith ..... 5/98.1
1,695,571 A * 12/1928 Baxter ..... 5/100
1,919,426 A * 7/1933 Minna ..... 5/658
1,948,048 A * 2/1934 Riley ..... 5/97
2,035,343 A * 3/1936 Riley ..... 5/97
2,130,703 A * 9/1938 Wylie et al. ..... 5/97
2,679,055 A * 5/1954 Ball et al. ..... 5/100
2,972,153 A * 2/1961 Turk ..... 5/429
D193,326 S * 8/1962 Hamilton ..... D6/391
3,063,066 A * 11/1962 Peck et al. ..... 5/429
3,763,507 A * 10/1973 Propst ..... 5/100
4,672,698 A 6/1987 Sands
4,811,436 A 3/1989 Schwartz
5,802,634 A * 9/1998 Onishi et al. ..... 5/93.2
5,845,349 A * 12/1998 Tharalson et al. ..... 5/93.1
5,970,539 A 10/1999 McDermott, Jr. et al.
6,487,735 B1 * 12/2002 Jacques et al. ..... 5/424

FOREIGN PATENT DOCUMENTS

AU 199869021 B2 12/1998
DE 200 04 390 U1 7/2000
WO WO 98/36666 A 8/1998

* cited by examiner

*Primary Examiner*—Michael Safavi
(74) *Attorney, Agent, or Firm*—Workman Nydegger

(57) ABSTRACT

A cot has at least one side comprising a sheet of flexible material having a lower end secured, preferably to a bottom rail, and an upper end which is preferably attached to an upper rail and which is capable of being raised and lowered by deformation of the flexible sheet to facilitate access to the cot. The cot also has releasable securing manes such as cords and cleats, to secure the sheet in a raised position. Preferably either end of the side can be raised or lowered relative to the other end of together with the other end.

9 Claims, 5 Drawing Sheets

COT

FIELD OF THE INVENTION

This invention relates to a cot, also known as a crib. The invention more particularly relates to a type of cot known as a dropside cot.

A cot is a bed, usually a small bed, with high sides and ends, for an infant such as a baby or very young child. However, cots can be made for older children and even adults, for example, to prevent restless sleepers from rolling off their beds.

BACKGROUND OF THE INVENTION

A conventional dropside cot comprises a base for supporting a mattress or the like, two upstanding ends, there being an upstanding end at each of opposite ends of the base, and two sides, there being a side at each of opposite sides of the base. The ends are usually solid ends whereas the sides are usually relatively open. In particular, each side usually comprises a top rail and a bottom rail which are joined by a plurality of equally spaced vertical bars. One side is usually fixed in a permanently upstanding position relative to the base, similar to the ends. The other side is a movable side or dropside, being capable of being moved from a raised position matching that of the other side and a lowered position to facilitate access to the cot. At each end of the cot there is a catch for engagement with the movable side of the cot when in its raised position in order to retain it in that position until the catches are released so that the movable side can be lowered. It is a feature of a dropside cot that the movable side is designed to be readily raised and lowered on an everyday basis, and usually on an every occasion of use basis. Therefore, it is not held in either its raised or lowered positions by fastenings that require tools to effect their release.

This conventional dropside cot has served well for many years. However, it is not altogether free of problems. First of all, because two catches are used to retain the movable side in its raised position, both catches must be released simultaneously to allow the side to be lowered. Furthermore, because the catches are at opposite ends of the cot, the simultaneous release of both catches requires a person to use both hands to achieve this. This may require a person carrying an infant to the cot to put the infant down in order to free both hands.

The vertical bars of the sides of the cot can be useful for an infant to pull itself up to a kneeling or standing position, assuming that the infant is old enough to be capable of doing this. However, the bars also present a problem in that they are hard and relatively rigid and can hurt an infant falling against them. Another problem can arise because of the spaces between the bars. An infant can have a limb protrude through the bars. While that in itself is not a problem, a problem does arise if the infant then assumes a body position where the limb is caught by the bars. The problem is greater if a very small infant can pass its head between the bars.

German Patent DE 20004390 U 1 (Schinkel) has done away with the vertical bars at the sides of the cot by using a woven fabric material extending between top and bottom rails at each side of the cot. At each end of the cot, the corresponding ends of the top and bottom rails are attached to the respective end-frame by having bolts pass through boltholes provided in the end-frames and into threaded boltholes provided in the ends of the top and bottom rails. The top and bottom rails can be set at different heights relative to the end-frames depending on which of several boltholes at different heights in the end-frames are used. Thus, when a child becomes old enough, the top rails maybe reset in a lower position so that the cot becomes more like a bed in appearance. However, this cot is not a dropside cot because neither of its sides is designed to be raised and lowered on an everyday basis, and usually on an every occasion of use basis. The use of bolts or the like is necessary in the cot of the German patent because the top and bottom rails form part of the cot framework but this means that a tool and significant time are required to change the height settings of the rails. Therefore the convenience of being readily able to raise and lower at least one side of the cot to facilitate access to the cot on every occasion of use is lost.

It is an object of the invention to address any one or more of the above-mentioned problems. Alternatively or additionally, it is an object of the invention to provide the public with a useful choice.

SUMMARY OF THE INVENTION

In a first aspect, the present invention broadly consists in a cot, wherein at least one side of the cot is a modified dropside comprising a sheet of a flexible material having a lower end which is secured and an upper end which at at least one end of the cot is capable of being raised and lowered by deformation of the flexible sheet of material to facilitate access to the cot, and wherein the cot has releasable securing means to secure the sheet of flexible material in a raised position.

In a second, more particular, aspect, the present invention consists in a cot comprising:

- a base for supporting a mattress or the like;
- two upstanding ends, there being an upstanding end at each of opposite ends of the base; and
- two sides, there being a side at each of opposite sides of the base;
- the cot being characterized in that at least one side is a modified dropside comprising a sheet of a flexible material having a lower end which is secured and an upper end which at at least one end of the cot is capable of being raised and lowered by deformation of the flexible sheet of material to facilitate access to the cot, and wherein the cot has releasable securing means to secure the sheet of flexible material in a raised position.

In a preferred cot, said at least one side of the cot also comprises a bottom rail that extends along that side and the lower end of the sheet of flexible material is secured by being attached to the bottom rail. The bottom rail is fixed in position, preferably between the ends of the bed.

In this preferred embodiment, said at least one side of the cot also comprises a top rail that extends along that side and the upper end of the sheet of material is attached to the top rail. The top rail is capable of being raised and lowered to effect raising and lowering of the sheet of flexible material. It is particularly preferred that it is possible to raise and lower one end of the top rail while the other end remains raised or lowered.

At each of opposite ends of the preferred cot there is a substantially vertical track with which a corresponding end of the top rail engages, the ends of the top rail being slidable up and down in the tracks. Each track preferably comprises a slot through which the corresponding end of the top rail passes. More preferably, each slot is located in and passes through a respective end of the cot. At each end of the top rail there is preferably a stop to prevent the ends of the top rail from being inadvertently disengaged from the slots. Each stop is preferably located to the outside of the respective slot.

In the preferred embodiment, the securing means comprises a cord attached at each end of the top rail and a cleat attached at each end of the cot. Each cord can be releasably attached to a respective cleat to secure at least that end of the top rail at a desired height. Each cleat is preferably a cam cleat and the cleats are preferably attached to inner faces of the ends of the cot. According to this preferred embodiment, from each end of the top rail, the respective cord passes over a respective bearing located above the maximum height that that end of the top rail can reach whereby at least that end of the top rail can be raised by a pulling downwardly on the free end of the cord. The bearing is preferably provided by an aperture in the respective end of the cot. The cord passes through the aperture and the free end of the cord is knotted or otherwise expanded to prevent it from being inadvertently pulled back through the aperture. Each cord may be attached to its respective end of the top rail by being attached to a shackle which is itself attached to the top rail. The shackles may then function as the previously mentioned stops preventing the top rail from being inadvertently disengaged from the slots. The preferred securing means, such as described above, can be released one at a time and when both are released the whole top rail may be lowered. However, in the preferred embodiment, it is possible to release only one of the securing means to enable the one end of the top rail to be lowered while the other end remains raised. So too, when the top rail as a whole is in the lowered position, one end of the top rail can be raised while the other end remains lowered.

The opposite side of the cot may have the same structure and operation as the first. However, it is preferred that the opposite side has a fixed height, in other words, it is in a permanently raised position. In this case, the opposite side of the cot may still have the same structure as the first side except that its top rail is fixed in position, preferably between the ends of the cot, that preventing the top rail from being moved to a lowered position.

The preferred flexible material is a mesh material. That allows air flow through it and also allows an infant or other person to see through it. The size of the mesh is preferably such that an infant cannot pass a limb, and certainly not the head, through the mesh. Preferably, the mesh is of a size such that an infant cannot even pass a finger or toe through it.

The preferred cot has legs. There may be four legs, one at each corner of the cot. In this case, each leg may continue upwardly above the base to provide corner posts forming parts of the sides and ends of the cot or to which the sides and ends are attached. The preferred cot has solid ends and the legs preferably comprise continuous extension of the ends. In this case it is possible for there to be only two legs, each leg extending across the width of the cot at its respective end of the cot.

BRIEF DESCRIPTION OF THE DRAWINGS

The above broadly defines the present invention and indicates various preferred features that may be incorporated in the cot. One preferred embodiment of the invention will now be described with reference to the accompanying drawings, in which.

DETAILED DESCRIPTION OF A PREFERRED EMBODIMENT

Figure 1:
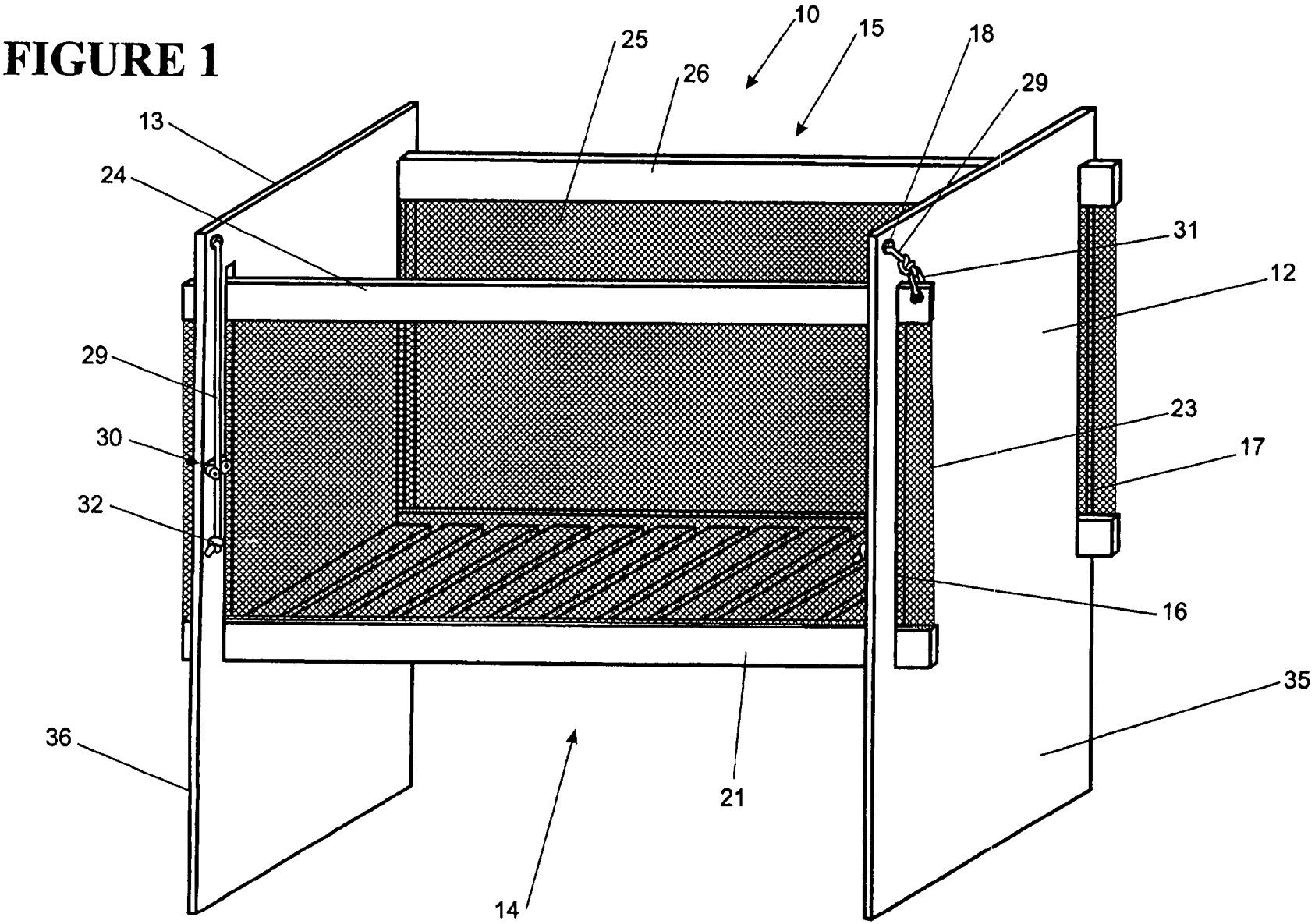
FIG. 1 shows a perspective view of the cot having one side where the top rail is movable between raised and lowered positions, the top rail being shown in the raised position.

The cot 10 comprises a base 11, two ends 12 and 13 and two sides 14 and 15.

Each of the ends 12 and 13 comprises a rectangular sheet of a rigid material. Each end has, at each side, and mostly in the upper half of the end, a vertical slot, being slot 16 towards the front side of the cot and slot 17 towards the back side of the cot. Above and slightly to the outside of the slot 16, each end has an aperture 18 fitted with a wear resistant grommet 19. In the drawings the ends 12 and 13 are planar but they could be curved outwardly towards the top ends for a different visual effect.

The base 11 extends between the ends and comprises a plurality of slats 20 lying parallel to the ends. The slats are slightly spaced for better aeration of the underside of a mattress (not shown). At each side of the cot, the ends of the slats are attached to and supported by a rail extending between and attached to the ends of the cot. In the embodiment shown in the drawings, the end of the slats at the front side of the cot may be attached to and supported by the rail 21, which also constitutes the bottom rail of the front side 14 of the cot. Similarly, the ends of the slats at the back side of the cot may be attached to and supported by the rail 22, which constitutes the bottom rail of the back side of the cot. Alternatively, the ends of the slats may be attached to and supported by other longitudinal rails (not shown) attached to the ends 12 and 13 and optionally attached to the bottom rails 21 and 22.

Figure 2:
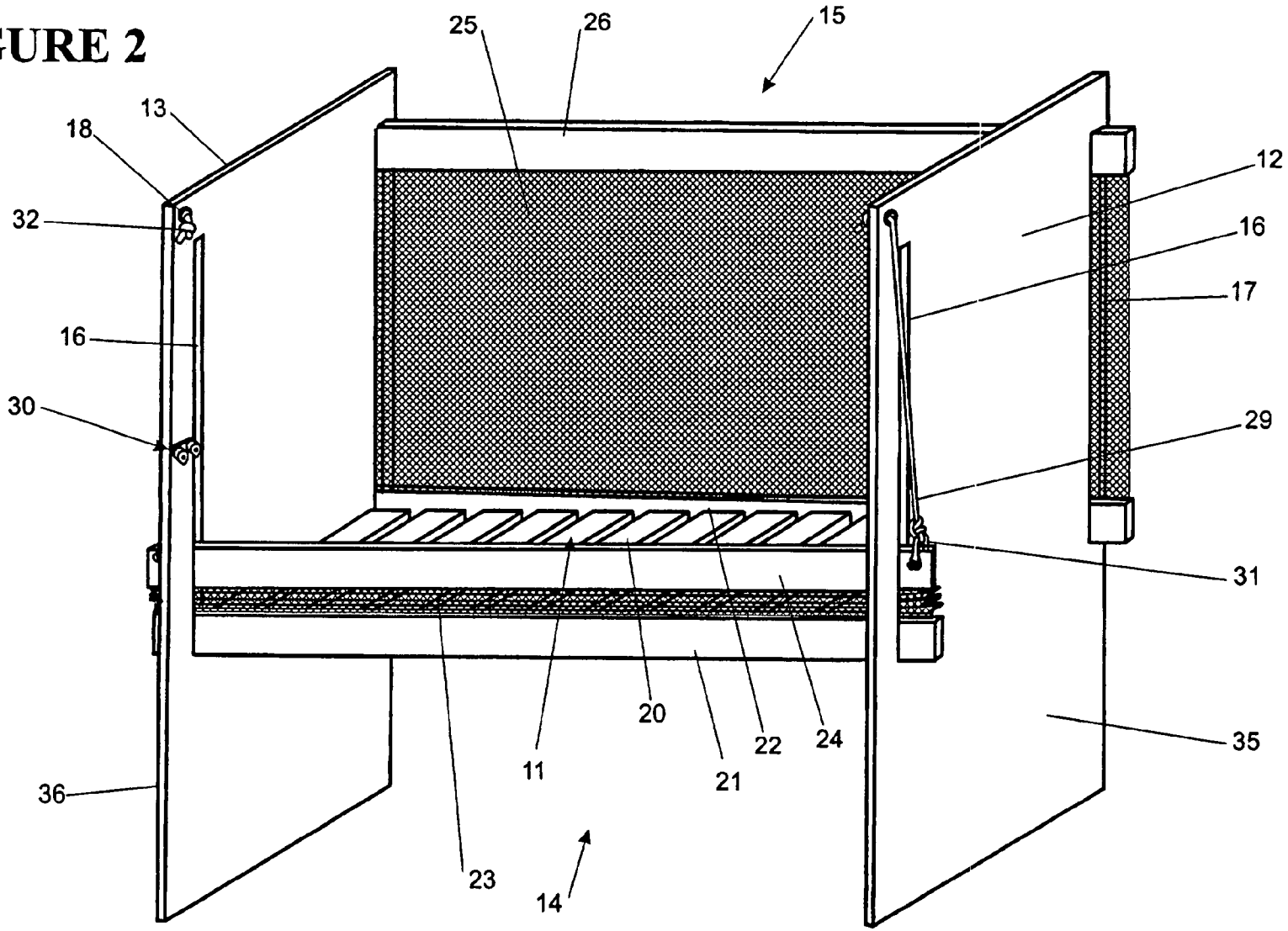
FIG. 2 shows a perspective view of the cot with the movable top rail in its lowered position.
Figure 3:
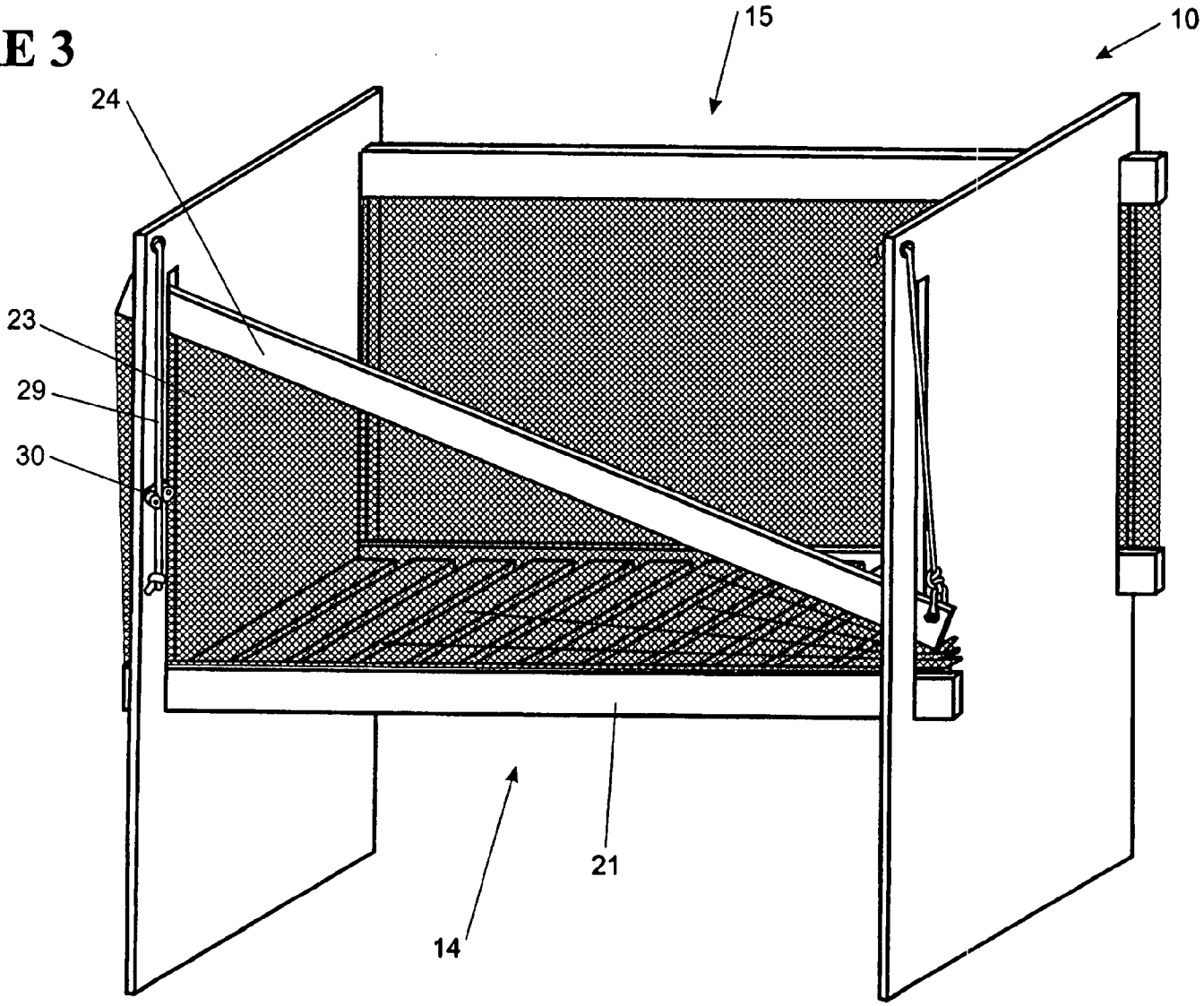
FIG. 3 shows a perspective view of the cot with the movable top rail having one end raised and the other end lowered.

The front side 14 of the cot comprises the bottom rail 21, a sheet of flexible material 23 and a top rail 24. The lower end of the sheet of flexible material is secured by being attached to the bottom rail 21. The upper end of the flexible sheet of material is attached to the top rail 24. The ends of the top rail protrude through the slots 16 and are slidable up and down in the slots. Therefore, the top rail 24 is movable between a raised position as shown in FIG. 1 and a lowered position as shown in FIG. 2. Deformation of the flexible material, for example, a serpentine folding of the flexible material as the top rail is lowered, permits this. It is not necessary for both ends of the top rail 24 to be lowered or raised together. Therefore, as a further feature, one end can be lowered while the other is left raised (as shown in FIG.

3) or one end can be raised while the other end is left lowered. This, in turn, allows the top rail 24 to be lowered completely and raised completely, one end at a time.

The back side 15 of the cot has the same basic structure as the front side 14. The sheet of flexible material 25 at the back has its lower end secured by being attached to the bottom rail 22 and its upper end is attached to the top rail 26. The ends of the top rail 26 protrude through the slots 17 in ends 12 and 13 but there is a difference from the front side in that the top rail 26 is attached to the ends in a permanently raised position. The reason the ends of the top rail 26 protrude through the slots 17 is to provide an appearance matching that of the top rail 24 when in its raised position.

The bottom rail 21 at the front of the cot also has its ends protruding through the slots 16 in the ends 12 and 13. That is partly to match the appearance of the top rail 24. The protruding ends of the top and bottom rails 24 and 26 have an additional useful function in that they carry the sheet of flexible material 23 beyond the ends 12 and 13 of the cot. That makes it difficult, if not impossible, for an infant in the cot to force any significant opening between the ends of the sheet of flexible material 23 and the ends 12 and 13 of the cot. The ends of the sheet of flexible material 25 and of the bottom rail 22 at the back side of the cot have a matching appearance and function.

Figure 4:
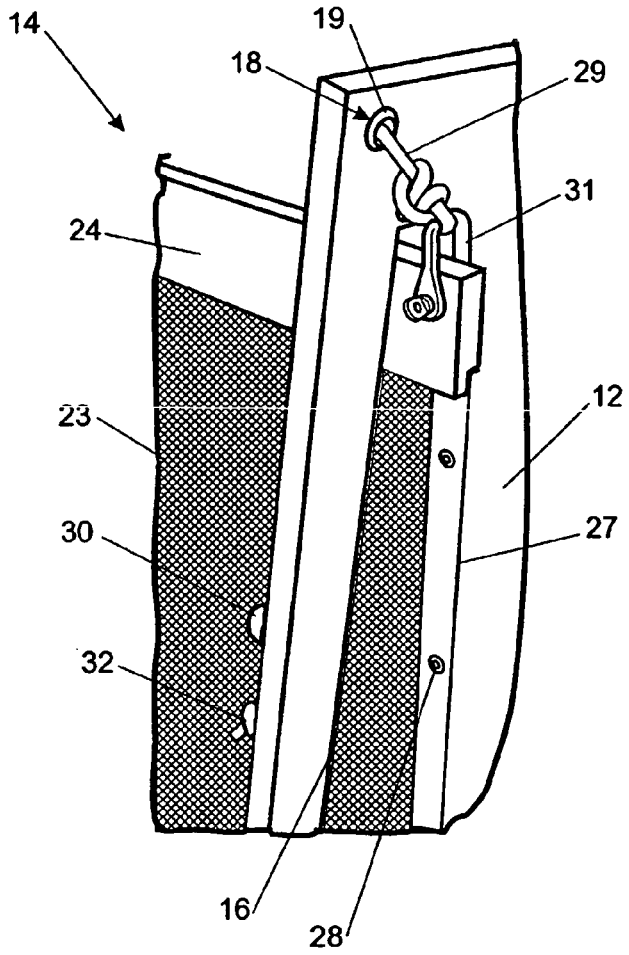
FIG. 4 is a perspective view looking onto an outer face of an end of the cot and showing details of a top corner of the cot with the top rail in the raised position.
Figure 5:
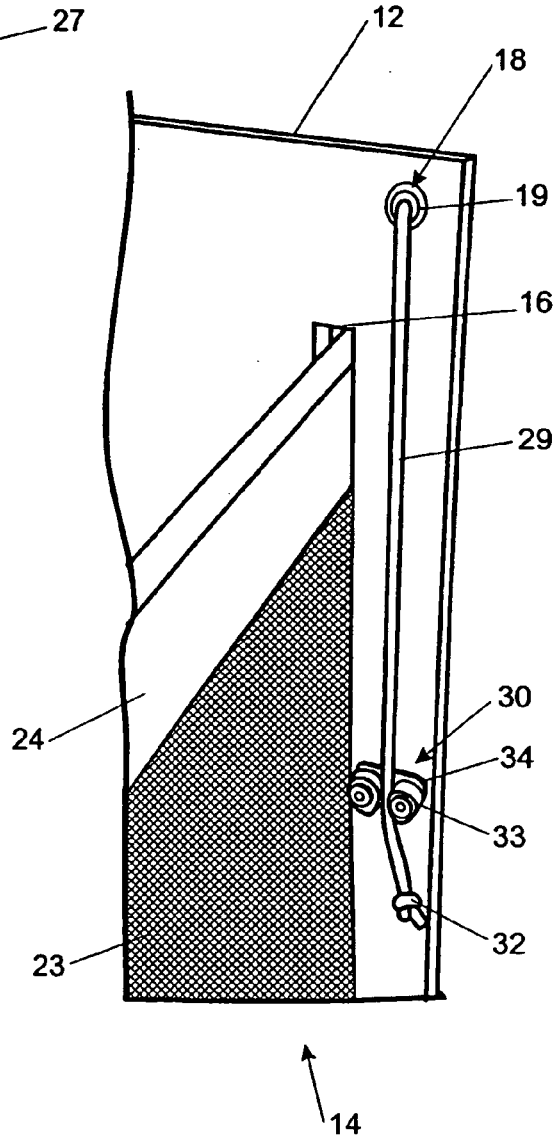
FIG. 5 is a perspective view looking onto an inner face of the same end of the cot as shown in FIG. 4, and showing further details of the top corner, the top rail still being in the raised position.
Figure 6:
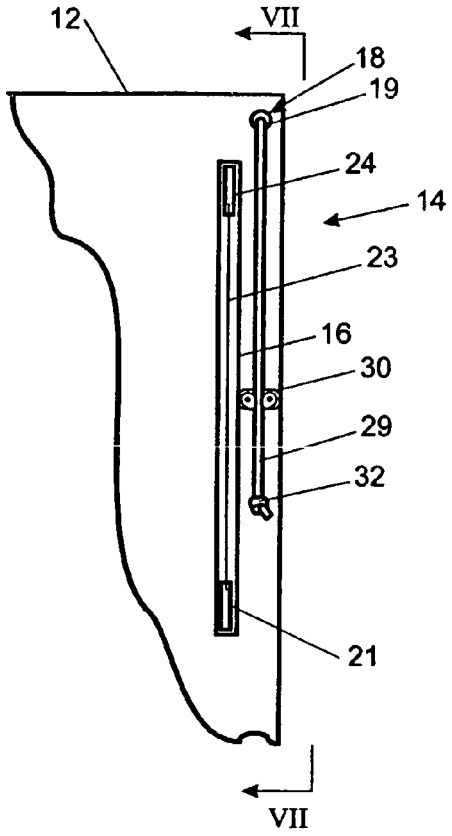
FIG. 6 is an elevation, showing a similar view to that of FIG. 5, with the top rail being in the raised position.
Figure 7:
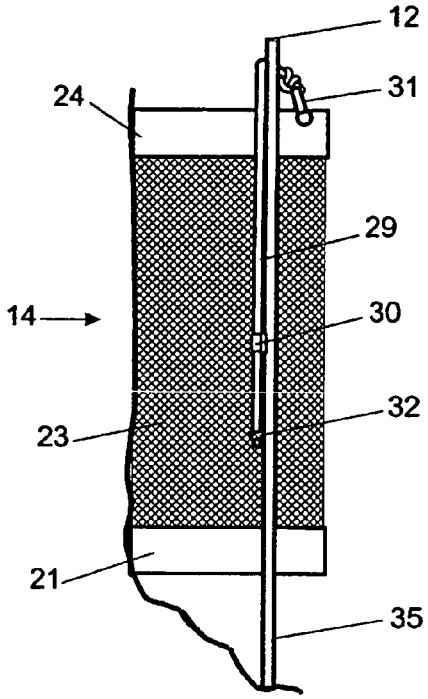
FIG. 7 is a side view on VII—VII of FIG. 6.
Figure 8:
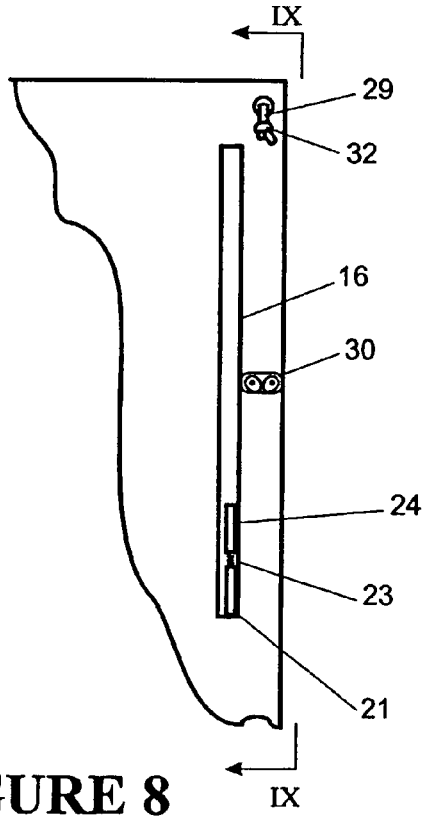
FIG. 8 shows the same elevational view as in FIG. 6 except that the top rail is in a fully lowered position.
Figure 9:
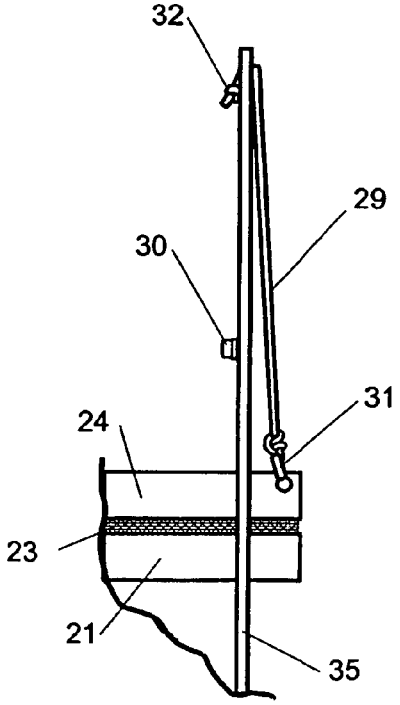
FIG. 9 is a side view on IX—IX of FIG. 8.

Each end of each sheet 23 and 25 of flexible material may be reinforced. For example, in FIG. 4 a flexible reinforcing strip 27 is shown attached at one end of the sheet 23. The attachment may be by sewing, adhesive bonding or any other suitable means. FIG. 4 shows eyelets 28 having been used, partly to assist in the attachment of the reinforcing strip and partly for visual appeal. The cot shown in the drawings has a nautical theme incorporated in its design.

The preferred flexible material from which the sheets 23 and 25 are made is a mesh material. This has advantages such as providing for better ventilation of the cot and allowing an infant and other people to see through the sides of the cot. The size of the mesh should be such that an infant cannot pass a limb, and especially a head, through the mesh. The preferred cot uses a mesh of a size such that an infant cannot even pass a finger or toe through the mesh. The mesh may be made of any suitable material, whether a natural fabric material or a synthetic material.

The cot has releasable securing means to secure the top rail 24 and its associated sheet of flexible material 23 in a raised position. In the preferred embodiment shown in the drawings, the securing means comprises a separate cord 29 attached at each end of the top rail 24, to the outside of the respective slot 16, and a cleat 30 attached on an inner face at each end of the cot. A shackle 31 is attached at each end of the top rail 24 beyond the respective end 12 or 13 of the cot. The shackles have three functions. They firstly provide stops which prevent the top rail 24 from being inadvertently removed from the slots 16 as their width is wider than that of the slots. They secondly provide a point of attachment for the ends of the cords 29. They thirdly provide a visually distinctive appearance, and in the embodiment shown in the drawings, contribute to the nautical design theme. From each shackle 31, the respective cord 29 passes up over a respective bearing located above the maximum height that that end of the top rail bearing the shackle can reach. The grommets 19 function as bearings through which the cords 29 slidably pass. The free end of each cord is therefore disposed on the inner face of the respective end 12 or 13 of the cot. The free end may be knotted as at 32 or otherwise enlarged so that it cannot be inadvertently pulled back through the grommet. A pulling downwardly on the free end of one of the cords 29 causes the associated end of the top rail 24 to be raised, whereupon the cord can be releasably attached to the respective cleat 30 to secure at least that end of the top rail at the desired height.

The preferred type of cleat 30 that is used is commonly called a cam cleat. A cam cleat has at least two gripping members 33 which are mounted in a spaced apart relationship. The gripping members provide a cord gripping passage between them through which a cord can extend. At least one, and preferably both of the gripping members, comprises a cam shaped gripping pawl mounted on a base member 54 for pivotal movement relative to the other gripping member. Movement of the gripping pawl towards the other gripping member closes the cord gripping passage so that a cord in the passage is gripped between the gripping members 33. Therefore, a cord placed between the gripping members can be pulled in one direction, and in this case downwardly, but not in the other direction, and in this case upwardly. The cord can be simply removed from the cleat by being pulled outwardly from the cleat. A suitable type of cam cleat is one made by Ronstan International Pty Limited and is described in their U.S. Pat. No. 4,956,897.

As can be seen from FIGS. 5–9, when an end of the top rail 24 is raised, the free end of the respective cord 29 is secured by the respective cleat 30 to prevent that end of the top rail falling back down. The cleat is positioned sufficiently far down the end 12 or 13 of the cot and to the outside of the sheet of flexible material 23 that the free end of the cord cannot be pulled from the cleat by an infant standing in the cot. When the free end of the cord is pulled from the cleat, which can be done by one hand, and the associated end of the top rail 24 is lowered, the knotted end 32 of the cord is disposed at or close to the associated grommet 19.

The securing means that has been described and shown in the drawings provides a simple yet effective means for moving each end of the top rail 24 from a lowered to a raised position and securing it in the raised position. It also provides for a ready release of the cord by one hand of a person outside the cot to allow the associated end of the top rail 24 to be lowered. In addition, it contributes to the nautical theme in the design of the cot.

Of course it is possible for a person with both hands free to manipulate the securing means at each end of the cot simultaneously. In this case both ends of the top rail 24 can be raised and lowered at the same time, the rail thereby being maintained in a substantially horizontal position as it is raised and lowered. However, in some cases it will be sufficient for only one end of the rail to be lowered to enable a person to place an infant into the cot or lift the infant from the cot.

In the cot shown in the drawings, the ends 12 and 13 of the cot extend below the base 11 to form two legs 35 and 36. These extend across the width of the cot. These legs could be provided with a central cutout from below, for example, a substantially n-shaped cutout so that each leg then becomes two legs, giving the cot four legs.

In another construction, the cot may have a post at each corner, the ends and sides of the cot being attached to the posts and the posts extending below the base to provide the four legs of the bed.

The above has described a preferred embodiment of the invention and has indicated some possible modifications. However, various other modifications can be made without departing from the scope of the invention as broadly defined in the claims that follow.

It is possible to have both sides of the cot having a top rail and hence an associated sheet of flexible material capable of being moved from a lowered position to a raised position and back again, though this is not usually necessary. The sheet of flexible material may be a non-perforated sheet, preferably of a tough transparent plastics material, though this is not favoured as it inhibits ventilation of the cot. Rather than have the lower end of the sheet of flexible material 23 at the front of the cot secured by being attached to the bottom rail 21, it could instead be attached to a spring loaded roller in the manner of a roller blind so that when the front side of the cot is being lowered the associated sheet of flexible material is automatically wound up by the roller. Such a roller could be mounted to each of the ends 12 and 13 of the cot or could instead be mounted to the bottom rail 21.

It is possible for the back side 15 of the cot to have a different construction altogether from that of the front side 14. For example, the back side of the cot could have vertical bars between the top and bottom rails, though this is not preferred for reasons already given. Alternatively, the back side of the cot could comprise a solid sheet of material as for the ends of the cot. Such sheets of material can be wooden materials, such as wood panels, particle board or plywood, and especially marine plywood. Other materials, such as plastic materials, for example, can be used instead. The base of the cot can have other constructions. The base could be a solid base or a spring woven base, for example. The base may even be made separable from the sides and ends of the cot to allow its removal for cleaning and airing.

It is possible for the movable side 14 of the cot to have no top rail 24. In this case the upper end of the sheet 23 would usually be reinforced, for example, by a similar reinforcing strip as that shown as reinforcing strip 27 in FIG. 4, and the cords 29 would be attached to this reinforcing strip.

The slots 16 in the ends 12 and 13 provide tracks for the ends of the rail 24. However, the slots need not be in the ends themselves. They could for example, be provided by attachments to corner posts of the cots. Furthermore, instead of having slots through which the ends of the top rail 24 protrude, the tracks could comprise channel sections within which the ends of the top rail are located. The depth of the channels would preferably be such that the top rail 24 could not fall out when one end was raised relative to the other. In another arrangement, the tracks could comprise a vertical rod at each end of the cot with each rod passing through a hole or, preferably, a slot in the respective end of the top rail, the top rail being slidable up and down on the rods.

In another embodiment of the top rail 24 can be raised and lowered directly by a hand gripping the rail. In this case the cords 29 and cleats 30 may be absent and other types of releasable catch or bolt used to retain the top rail in its raised position.

The cleats 30 may be a conventional type of fixed cleat about which the free ends of the cords 29 are wound. Alternatively, the cleats may be replaced by hooks with which loops provided at the free ends of the cords 29 may engage. One possible problem with using just cleats, such as the cam cleats described, or just hooks and loops, is that a toddler outside the cot could cause disengagement of these securing means by playing with the cords. This can be addressed, at least in part, by utilising both forms of securing means at each end of the cot, so that first one then the other must be disengaged to allow the associated end of the top rail 24 to be lowered. Furthermore, when hooks are used, whether or not in conjunction with cleats, the downwardly facing opening of each hook may normally be substantially closed by a resilient stopper which requires some force to move the loop at the free end of the associated cord past it, either to engage or disengage the loop from the hook. When both a cleat and a hook are used at each end of the cot, the hook is preferably located below the cleat. A hook with a resilient stopper has another advantage, in preventing a loop at the free end of the cord engaged with the hook from inadvertently disengaging from the hook if there is slackness in the cord between the cleat and the hook.

It will be realized by people skilled in the art that the securing means can take many forms other than cleats and/or hooks, or cleats and/or hooks as have been described.

The flexible sheets of material 23 and 25 can be releasably attached by appropriate fasteners to their respective top and bottom rails so that they can be removed for cleaning or replacement.

Thus, it can be seen that the present invention can be incorporated in cots having a wide range of constructions and designs although not every embodiment will necessarily include all the features of the preferred embodiment of the invention.

What I claim is:

1. A cot, wherein:

a) at least one side of the cot is a modified dropside comprising a sheet of a flexible material having a lower end which is secured and an upper end which is capable of being raised and lowered by deformation of the flexible sheet of material to facilitate access to the cot;

b) at each of opposite ends of the cot there is a substantially vertical track, each track comprising a slot through which the corresponding end of the flexible sheet passes, the ends of the flexible sheet being slidable up and down in the slots, it being possible to raise and lower one end of the flexible sheet while the other end remains raised or lowered; and wherein c) the cot has releasable securing apparatus to secure the sheet of flexible material in a raised position.

2. A cot according to claim 1, wherein said at least one side of the cot also comprises a top rail that extends along said at least one side and the upper end of the sheet of flexible material is attached to the top rail, each end of said top rail passing through the slot defining the vertical track at the corresponding end of die cot and being slidable up and down in said track whereby said top rail is capable of being raised and lowered to effect raising and lowering of the sheet of flexible material, and wherein either end of the top rail can be raised and lowered while the other end remains raised or lowered.

3. A cot according to claim 2, wherein the securing apparatus comprises a cord attached at each end of the top rail and a fastening device attached at each end of the cot, wherein from each end of the top rail, the respective cord passes over a respective bearing located above the maximum height that that end of the top rail can reach whereby at least that end of the top rail can be raised by a pulling downwardly on a free end of the cord, and wherein each cord can be releasably attached to a respective fastening device to secure at least that end of the top rail at a desired height.

4. A cot comprising:

a) a base for supporting a mattress;

b) two upstanding ends, there being an upstanding end at each of opposite ends of the base;

c) two sides, there being a side at each of opposite sides of the base, at least one side being a modified dropside comprising:

i) a sheet of a flexible material having a lower end that is secured and an upper end that is capable of being raised and lowered by deformation of the sheet to facilitate access to the cot;

ii) a bottom rail that extends along said at least one side with the lower end of the sheet being attached to the bottom rail, said bottom rail being fixed in position; and iii) a top rail that extends along said at least one side with the upper end of the sheet being attached to the top rail, said top rail being capable of being raised and lowered to effect raising and lowering of the sheet;

d) a substantially vertical slot in each end of the cot, through which slots corresponding ends of the top rail, the bottom rail and the sheet pass, the ends of the top rail being slidable up and down in the slots, it being possible to raise and lower one end of the top rail while the other end remains raised or lowered; and e) releasable securing apparatus to secure the top rail and hence the sheet of flexible material in a raised position.

5. A cot comprising:

a base having a first side and an opposing second side;

a first end frame upstanding from the base and a spaced apart second end frame upstanding from the base;

a first sheet of flexible material extending between the first end frame and the second end frame along or adjacent the first side of the base, the first sheet having a lower end secured at or adjacent to the base and an opposing upper end;

a top rail secured along the upper end of the first sheet;

a first track comprising a vertical slot formed on the first end frame; and a second track comprising a vertical slot formed on the second end frame;

wherein the top rail and the first sheet at least partially pass through the slot of the first track and the slot of the second track, the top rail being selectively movable in the slots between a raised position and a lowered position by deformation of the first sheet so as to effect moving of the first sheet between the raised position and the lowered position, it being possible to raise and lower one end of the top rail while the other end remains raised or lowered.

6. A cot according to claim 5, further comprising:

a releasable securing apparatus configured to secure the first sheet in the raised position, the securing apparatus comprising:

a cord connected with the top rail; and a fastening device attached to the first end frame or the second end frame, wherein the cord can be releasably attached to the fastening device to secure the top rail at a desired height; and a bearing located above the maximum height that the top rail can reach, the cord passing over the bearing so that the top rail can be raised by pulling downwardly on a portion of the cord.

7. A cot according to claim 5, further comprising a second sheet of flexible material extending between the first end frame and the second end frame in substantial alignment with the second side of the base and having a lower end secured at or adjacent to the base and an opposing upper end, a second top rail secured along the upper end of the second sheet, a second vertical slot formed on the first end frame and a second vertical slot formed on the second end frame, wherein the second top rail and the second sheet at least partially pass through each of the second vertical slots.

8. A cot according to claim 7, wherein the second top rail is permanently secured in a raised position.

9. A cot comprising:

a) a base for supporting a mattress;

b) two upstanding end frames, there being an upstanding end frame at each of opposite ends of the base;

c) two sides, there being a side at each of opposite sides of the base, at least one side being a modified dropside comprising:

i) a sheet of a flexible material having a lower end that is secured and an upper end that is capable of being raised and lowered by deformation of the sheet to facilitate access to the cot;

ii) a bottom rail extending along the at least one side with the lower end of the sheet being attached to the bottom rail, the bottom rail being fixed in position; and iii) a top rail extending along the at least one side with the upper end of the sheet being attached to the top rail, the top rail being capable of being raised and lowered to effect raising and lowering of the sheet;

d) a substantially vertical slot in each end frame, the ends of the top rail, the bottom rail and the sheet passing through each slot, the ends of the top rail being slidable up and down in the slots, wherein either end of the top rail can be raised and lowered while the other end remains raised or lowered; and e) releasable securing apparatus to secure the top rail and hence the sheet of flexible material in a raised position.

* * * * *